US006796139B2

(12) United States Patent
Briley et al.

(10) Patent No.: US 6,796,139 B2
(45) Date of Patent: Sep. 28, 2004

(54) METHOD AND APPARATUS FOR ARTIFICIAL GROUND FREEZING

(75) Inventors: George Briley, San Antonio, TX (US); Joe Sopko, Cedar Grove, WI (US)

(73) Assignee: Layne Christensen Company, Mission Woods, KS (US)

( * ) Notice: Subject to any disclaimer, the term of this patent is extended or adjusted under 35 U.S.C. 154(b) by 0 days.

(21) Appl. No.: 10/375,521

(22) Filed: Feb. 27, 2003

(65) Prior Publication Data

US 2004/0168460 A1 Sep. 2, 2004

(51) Int. Cl.[7] ..... F25D 23/12; A63C 19/10; F25B 7/00

(52) U.S. Cl. ..... 62/260; 62/235; 62/335

(58) Field of Search ..... 62/260, 235, 335

(56) References Cited

U.S. PATENT DOCUMENTS

| | | | | |
|---|---|---|---|---|
| 4,169,356 A | * | 10/1979 | Kingham | 62/85 |
| 4,475,353 A | * | 10/1984 | Lazare | 62/101 |
| 4,860,544 A | | 8/1989 | Krieg et al. | |
| 5,667,339 A | * | 9/1997 | Dash | 405/130 |
| 5,818,131 A | | 10/1998 | Zhang | |
| 5,852,939 A | | 12/1998 | Gazes | |
| 6,161,391 A | * | 12/2000 | Trieskey | 62/79 |
| 2001/0023594 A1 | | 9/2001 | Ives | |
| 2002/0023576 A1 | | 2/2002 | Swanson | |

FOREIGN PATENT DOCUMENTS

| | | |
|---|---|---|
| DE | 2912134 A1 | 3/1979 |
| JP | 406201204 A | 7/1994 |
| JP | 02002048422 A | 2/2002 |

OTHER PUBLICATIONS

Ives, Refrigeration System, Sep. 27, 2001. US PGP, all.*

* cited by examiner

*Primary Examiner*—William C. Doerrles
*Assistant Examiner*—Filip Zec
(74) *Attorney, Agent, or Firm*—Shook, Hardy & Bacon L.L.P.

(57) ABSTRACT

A ground freezing method and system which circulates refrigerated heat transfer fluid through freeze pipes in the ground at a low temperature of at least −52° C. (−62° F.) to minimize drilling for the freeze pipe installation. The heat transfer fluid is preferably aqua ammonia (ammonium hydroxide) because of its beneficial characteristics in this application. The circulating heat transfer fluid is preferably cooled by a refrigeration system that includes low and high stage cycles arranged in a cascade relationship and using ammonia or another refrigerant in the high stage refrigeration system and carbon dioxide as the refrigerant in the low stage refrigeration system.

4 Claims, 1 Drawing Sheet

METHOD AND APPARATUS FOR ARTIFICIAL GROUND FREEZING

FIELD OF THE INVENTION

This invention relates generally to artificial ground freezing and more particularly to an improved process and system that has particular utility in large scale ground freezing applications.

BACKGROUND OF THE INVENTION

Artificial ground freezing has been used for many years to freeze selected areas of the ground for a number of different purposes. It is often used to provide support for excavations or to cut off ground water seepage, although it can be used for applications such as the confinement of hazardous materials in the ground and creating impermeable zones for hydrocarbon or mineral extraction or processing.

When the soil is frozen, the water within the soil freezes and bonds the soil particles together. It has been determined that colder soil temperature significantly increase the strength of the frozen soil, to the point where its compressive strength can equal that of some types of concrete. The combination of high strength and impermeability makes frozen soil useful as a shoring system for deep excavations. By way of example, mine shafts well over 1000 feet deep have been completed using ground freeze shoring techniques. Frozen soil walls for preventing ground water or chemicals in the soil from migrating through the ground have been formed to provide a barrier in cases where there is no need for an open excavation such as a mine or tunnel.

In a conventional ground freeze application, drilling is carried out to form spaced apart bores in which freeze pipes are installed around the perimeter of the proposed excavation or along the ground water barrier. Typically, the freeze pipes are steel pipes three to four inches in diameter installed three to six feet apart along the site of the proposed wall of frozen soil. The most commonly used technique involves circulating a refrigerated liquid through the freeze pipes. Salt water brine and ethylene glycol can be used, and they are cooled using a vapor compression cycle refrigeration system that employs a refrigerant such as ammonia, R-22 or other refrigerant. The refrigeration plant is specially designed for ground freezing and may be either mobile or stationary. After the circulating fluid has been chilled, it is pumped through the freeze pipes and is returned to be cooled again by the refrigeration plant. The entire system is closed to the atmosphere.

As the cold liquid circulates through the freeze pipes, the soil around each individual pipe freezes. As more time passes and more circulating liquid is pumped through the freeze pipes, the frozen zone of soil around each pipe is enlarged until the adjacent zones eventually merge to form a barrier that is impermeable. As the freezing process continues and additional freezing occurs, the frozen barrier increases in thickness and the temperature decreases. The result is that a continuous barrier is created so that excavation can take place or, in the case of a ground water barrier, a containment wall is formed.

Another ground freezing technique that has been used is known as a direct expansion process in which a cryogenic fluid such as liquid nitrogen or liquid carbon dioxide is applied to the freeze pipes. The fluid boils to a vapor to extract heat from the soil and then discharges to the atmosphere. In an open system of this type, the fluid is not recirculated but is essentially lost to the atmosphere. The advantage of the direct expansion system is that it freezes the ground much faster than a brine circulation system. However, the cryogenic fluids are so costly that it is not practical to use them in many applications and particularly in large scale projects.

Each ground freezing project requires an evaluation to determine the appropriate spacing between the freeze pipes. Increasing the spacing between pipes results in a longer time required for the ground to be frozen to form the barrier. Three to six weeks of freeze time is typical for the freeze zone to be completed with the necessary permeability. The time can be reduced by either using a colder circulating fluid or by reducing the pipe spacing. However, if the pipe spacing is reduced, more drilling is required. Because drilling is the single most costly aspect of a ground freezing project, it is highly undesirable to space the pipes close together. Conversely, the overall cost can be reduced significantly by increasing the pipe spacing to decrease the drilling requirements. With increased distance between pipes, the only way for an effective frozen barrier to be formed in a reasonable time period is to decrease the temperature of the coolant that is circulated through the freeze pipes.

On some projects, coolant temperatures must be about −52° C. (−62° F.) or less to allow a pipe spacing that is consistent with a reasonably low drilling cost. However, conventional circulating fluids such as calcium chloride brine or ethylene glycol cannot attain such a low temperature.

BRIEF SUMMARY OF THE INVENTION

The present invention is directed to a method and apparatus for ground freezing that makes use of cooling techniques resulting in circulating fluid temperature of −50° C. (−58° F.) or less. This has the great advantage of allowing the freeze pipes to be spaced relatively far apart while still creating an impermeable frozen earth barrier in a reasonable period of time. The saving in drilling cost that results from the need for fewer freeze pipe bores creates a major economic benefit making ground freezing practical for very large projects.

In accordance with the invention, a refrigeration system is used to cool a circulating heat transfer fluid to a temperature of −52° C. (−62° F.) or less. The heat transfer circulating fluid is preferably aqua ammonia (ammonium hydroxide) with 27–30% ammonia, which has the advantage of being readily available at a low cost and the ability to serve as an efficient heat transfer fluid. Equally important, aqua ammonia (ammonium hydroxide) has a very low viscosity (actually less than water at −52° C.) so that it can be easily pumped through the freeze pipes to minimize pumping costs and difficulties.

The refrigeration plant used to cool the circulating fluid may advantageously employ low and high stage vapor compression refrigeration systems arranged in a cascade relationship with one another. The low stage system may use carbon dioxide as its refrigerant with its condenser arranged to discharge its heat to the evaporator of the high stage system. Ammonia is preferably the refrigerant in the high temperature system. However, R-22 or other refrigerant may be employed. In this way, the low temperature system can cool the circulated fluid to the requisite temperature −52° C. (−62° F.) or less and thus allow the freeze pipes to be spaced relatively far apart far so that the drilling costs are low enough to make ground freezing practical in large scale projects.

Other and further objects of the invention, together with the features of novelty appurtenant thereto, will appear in the course of the following description.

BRIEF DESCRIPTION OF THE SEVERAL VIEWS OF THE DRAWING

In the accompanying drawing which forms a part of the specification and is to be read in conjunction therewith and in which like reference numerals are used to indicate like parts in the various views.

DETAILED DESCRIPTION OF THE INVENTION

Figure 1:
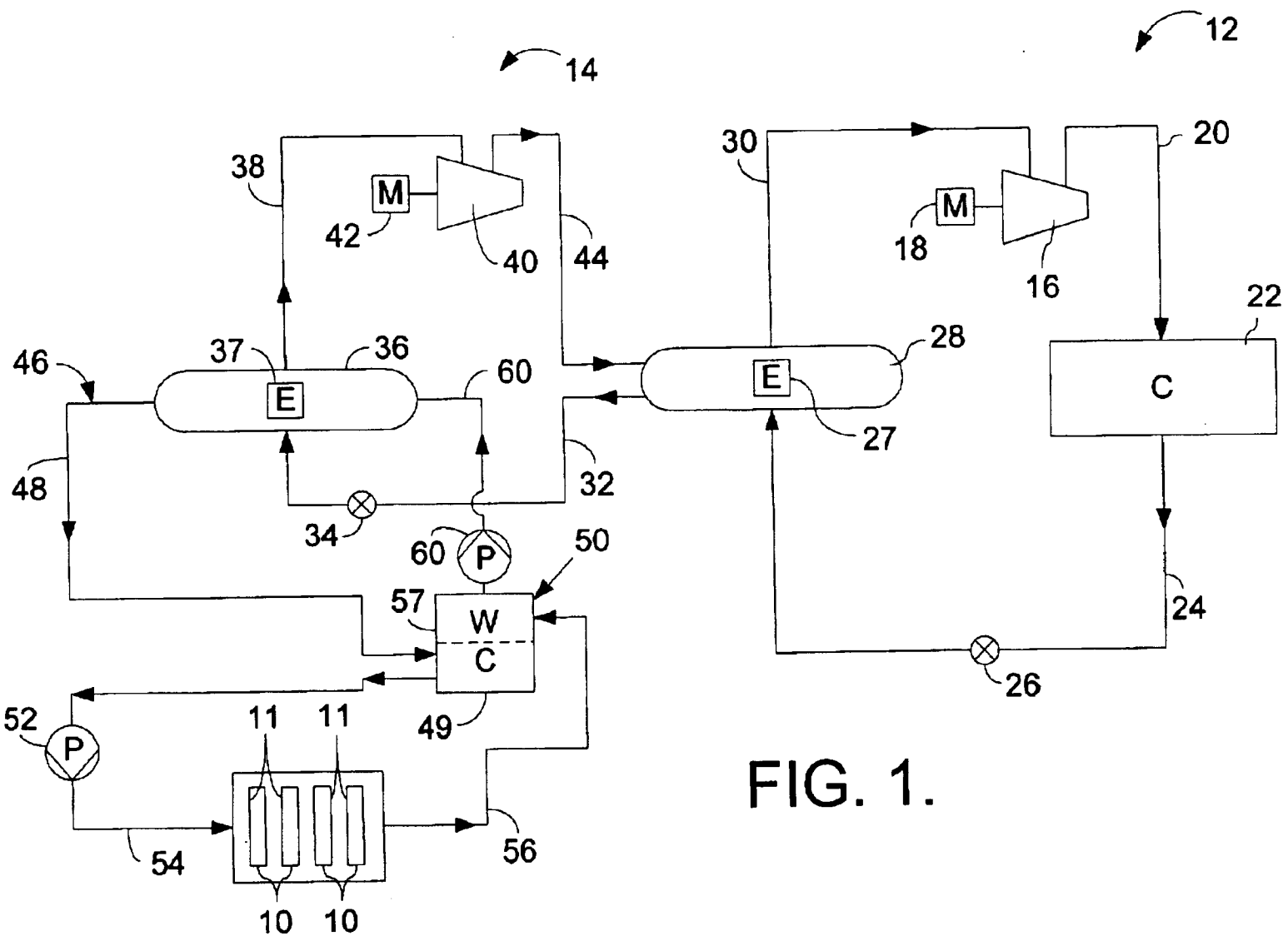
FIG. 1 is a schematic diagram of a ground freezing system constructed and arranged according to a preferred embodiment of the present invention.

Referring now to the drawing in more detail, the present invention is directed to a ground freezing system in which a plurality of freeze pipes 10 are installed in the ground in bores 11 that are drilled at spaced apart locations along an impermeable barrier that is to be formed by freezing the ground along the barrier. The drilling of the bores 11 and installation of the freeze pipes 10 in them are accomplished by techniques that are well known in the art. As also well known in the art, a refrigerated heat transfer liquid can be circulated through the pipes 10 in order to freeze the ground around the pipes and eventually form an impermeable barrier extending between the pipes when the frozen areas around the pipes become large enough to merge into a unitary barrier.

In accordance with a preferred embodiment of the present invention, a refrigeration plant for cooling the circulating liquid may include a high stage refrigeration system generally identified by numeral 12 and a low stage refrigeration system generally identified by numeral 14. The refrigeration systems 12 and 14 may incorporate conventional vapor compression refrigeration cycles. The two systems 12 and 14 are arranged in a cascade relationship with one another.

The high stage refrigeration system 12 preferably uses ammonia as the refrigerant. However, other refrigerants may also be employed. The ammonia in gas form is compressed by a conventional compressor 16 driven by a motor 18. The compressed ammonia is discharged from the compressor 16 along a vapor line 20. Line 20 leads to a condenser 22 in which the gaseous refrigerant is condensed to provide a liquid which is discharged from the condenser 22 along a liquid line 24. The liquid ammonia in line 24 may have a temperature of approximately 95° F. (35° C.). The liquid line 24 leads through an expansion valve 26 to an evaporator 27 contained in a heat exchanger 28. The ammonia gas is directed from the heat exchanger 28 along line 30 to the compressor 16 which compresses it again. The temperature in line 30 may be approximately (−15° F.) (−26° C.).

The condenser of the low stage refrigeration system 14 is part of the heat exchanger 28 and discharges its heat to the evaporator 27 of the high stage system 12. The refrigerant used in the low stage system 14 may be carbon dioxide. The liquid refrigerant from the high sage condenser flows through line 32. Line 32 extends through an expansion valve 34 to another heat exchanger 36 which contains the evaporator 37 of the low stage system 14. The carbon dioxide vapor is directed from the evaporator 37 along line 38 which leads to a compressor 40 driven by a motor 42. The compressed vapor is discharged from the compressor 40 along line 44 to the condenser in the heat exchanger 28. The refrigerant temperature in line 32 may be approximately −5° F. (−20° C.).

A circulation path generally identified by numeral 46 is provided for the heat transfer fluid that is pumped through the freeze pipes 10. The cold heat transfer fluid which is circulated through the circulation path 46 is preferably aqua ammonia (ammonium hydroxide) which may contain 27%–30% ammonia dissolved in water. This fluid is particularly advantageous because it is readily available at a low cost and functions as an effective and efficient heat transfer fluid. It also has a relatively low viscosity so that it can be pumped easily through the circulation path 46.

The circulation path 46 passes through the heat exchanger 36 such that the evaporator 37 of the low stage refrigeration system 14 extracts heat from the aqua ammonia (ammonium hydroxide) that is circulated through the circulation path 46. The cooled liquid discharged from the heat exchanger 36 is directed through line 48 to a cold section 49 of a two compartment tank 50. The tank 50 and the entire circulation path 46 are maintained at a positive pressure so that the ammonia in the heat transfer fluid is kept at a positive pressure. The temperature of the heat transfer fluid in line 48 is approximately −62° F. (about −52° C.). A pump 52 pumps the liquid from the cold section on the tank 50 along a line 54 leading to the freeze pipes 10. After passing through the freeze pipes 10, the circulating liquid is directed along line 56 to a warm section 57 of tank 50 which is likewise maintained at a positive pressure. A pump 60 pumps the circulating fluid from the warm section of tank 50 along a line 62 leading to the heat exchanger 36. The temperature of the fluid in line 62 may be approximately −50° F. (−48° C.).

In operation, the low stage system 14 discharges its heat to the evaporator 27 of the high stage refrigeration system 12. The evaporator 37 of the low temperature refrigeration system 14 similarly extracts heat from the heat transfer fluid in the circulation path 46, thus cooling the heat transfer fluid in path 46 to a low temperature at or below −52° C. (−62° F.). Consequently, the temperature of the fluid applied to the freeze pipes 10 is at or below −50° C. (−58° F.), and the pipes 10 can be spaced relatively far apart so that the number of drilled bores 11 that is required for the freeze pipes is reduced, along with the drilling costs. The cascade arrangement of the refrigeration systems 12 and 14 and the use of ammonia in the high stage system and carbon dioxide in the low stage system as the refrigerants is advantageous because it results in the heat transfer fluid in path 46 being cooled to the desired low temperature of −52° C. (−62° F.) or less. Aqua ammonia (ammonium hydroxide) is preferred for the heat transfer fluid because of the advantages previously indicated. The cold section 49 and warm section 57 of the tank 50 allow for accumulation of the circulating fluid and are maintained at positive pressures in order to prevent heat transfer fluid from being subjected to a vacuum. The cold and warm sections can be constructed as separate tanks if desired.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. Ground freezing apparatus comprising:

a high stage refrigeration system and a low stage refrigeration system arranged in a cascade relationship;

a first heat exchanger using a first refrigerant in said high stage refrigeration system to extract heat from a second refrigerant in said low stage refrigeration system;

a plurality of freeze pipes in the ground;

a circulation path extending through said freeze pipes having a low temperature heat transfer fluid circulating therein to freeze the ground in proximity to said freeze pipes; and a second heat exchanger through which said circulation path passes, said second heat exchanger using said second refrigerant to extract heat from said heat transfer fluid for cooling thereof, said heat transfer fluid comprising aqua ammonia cooled to a temperature less than about −52° C. when passed through said second heat exchanger.

2. Apparatus as set forth in claim 1, wherein said heat transfer fluid comprises ammonia and water with the ammonia content thereof being in the range of about 27%–30%.

3. Apparatus as set forth in claim 1, wherein said circulation path is maintained at a positive pressure.

4. Apparatus as set forth in claim 1, including:

a cold tank in said circulation path along a portion thereof extending from said second heat exchanger to said freeze pipes for holding the heat transfer fluid; and a warm tank in said circulation path along a portion thereof extending from said freeze pipes to said second heat exchanger for holding the heat transfer fluid, said cold tank and said warm tank being maintained at positive pressures.

* * * * *